United States Patent [19]

King

[11] 4,014,270

[45] Mar. 29, 1977

[54] KNOCK-DOWN CONSTRUCTION

[76] Inventor: Paul Anstee Frank King, 7 Victoria St., Paddington, New South Wales 2021, Australia

[22] Filed: Feb. 9, 1976

[21] Appl. No.: 656,843

[52] U.S. Cl. ..... 108/111; 108/153

[51] Int. Cl.[2] ..... A47B 3/00

[58] Field of Search ..... 108/101, 111, 153, 156, 108/157, 159; 312/257 R, 257 A, 257 SK, 264, 265

[56] References Cited

UNITED STATES PATENTS

| | | | |
|---|---|---|---|
| 3,029,119 | 4/1962 | Spadolini | 312/264 |
| 3,132,910 | 5/1964 | Vigna | 312/264 |
| 3,326,149 | 6/1967 | Mitchell et al. | 108/111 |
| 3,945,696 | 3/1976 | Yellin | 312/257 R |

*Primary Examiner*—James C. Mitchell
*Attorney, Agent, or Firm*—Mason, Fenwick & Lawrence

[57] ABSTRACT

A knock-down furniture construction arrangement is disclosed in which the use of tools and securing devices in assembly is avoided by employing a rigid planar frame within which opposed parallel panels are constrained by engagement between the sides of the frame.

7 Claims, 6 Drawing Figures

KNOCK-DOWN CONSTRUCTION

This invention relates to a knock-down structural arrangement suitable for use in the manufacture of furniture and other structures, and utilizing in an efficient manner the properties of materials such as plywood and so-called "particle board".

As is well known, the manufacture of furniture and other products in a knock-down form, whereby the integers of the product are sold in their finished but non-assembled condition for assembly by the user with the minimum employment of special tools, enables the most efficient transport of such products, and in fact enables economic long distance transport of finished products, particularly in the export market, where this would otherwise be uneconomic.

While the use of particle board as a material in the construction of furniture and other wooden structures is wide spread, this use is limited at present by the difficulty of providing satisfactory joints particularly in view of the softness of the material. The invention aims to provide a form of structural assembly employing particle board which, by increasing the amount of particle board which may be employed in such products, and by facilitating the use of knock-down construction of such products, will enable a more efficient utilization of the timber resources of the country and a greater value content in exported products manufactured in the employment of those resources. In one of its forms, the present invention also enables particle board to be used as a structural member in such products rather than merely in non load-bearing applications.

The prior art approaches to the use of sheet material such as plywood or particle board have involved the traditional approach of fixing sheets of the board at right angles to each other by means of securing devices traditionally used for other materials, and have therefore required the use of additional securing elements attached to the respective boards, or a rigid three dimensional frame has been employed to obtain the required rigidity of the final assembly. Unless such a frame was employed, the softness of the particle board made it very difficult to achieve the required structural rigidity.

In the manufacture of knock-down furniture these approaches are undesirable, as they necessitate the use of tools for the final assembly, and of course the use of a space frame prevents the use of flat packaging and thus eliminates the economies of the knock-down approach.

The present invention avoids these disadvantages by employing a single planar frame within which opposed parallel panels are constrained. In this way a rigid structure can be achieved without the use of tools, and the simple planar frame is well adapted to flat packaging along with the remaining unassembled elements of the product.

The present invention broadly resides in a knock-down structural arrangement comprising at least one rectangular frame and two panels adapted to be placed in parallel relationship within said frame closely adjacent respective opposite sides thereof such that each panel engages the remaining sides of the frame by means of the engagement of the respective remaining side within a recess in said panel.

In various embodiments of the invention, either the panel of the frame or both will normally be extended beyond the basic structure thus defined, to form the required surfaces or frame structure for the particular purpose at hand. This will become clear from the following description of preferred embodiments of the invention which are given by way of example only, with reference to the accompanying drawings in which.

Figure 1:
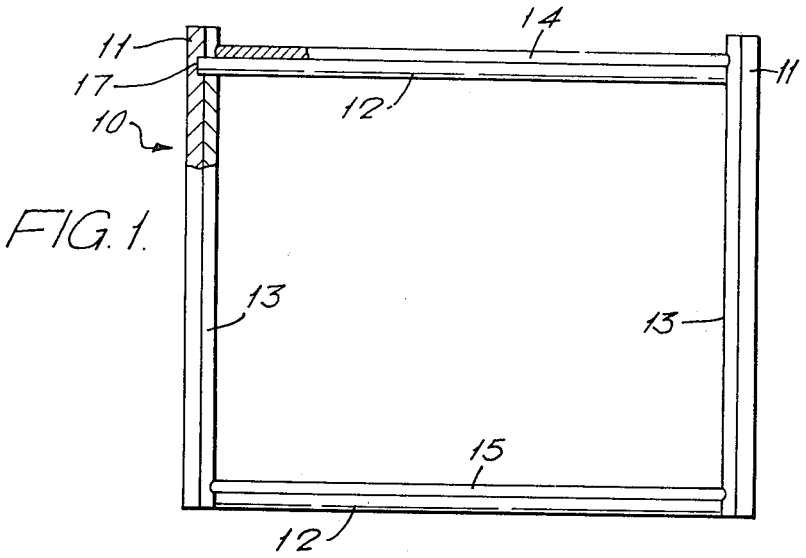
FIG. 1 shows in front partly sectioned elevation a partly assembled book shelf constructed in accordance with the present invention.
Figure 2:
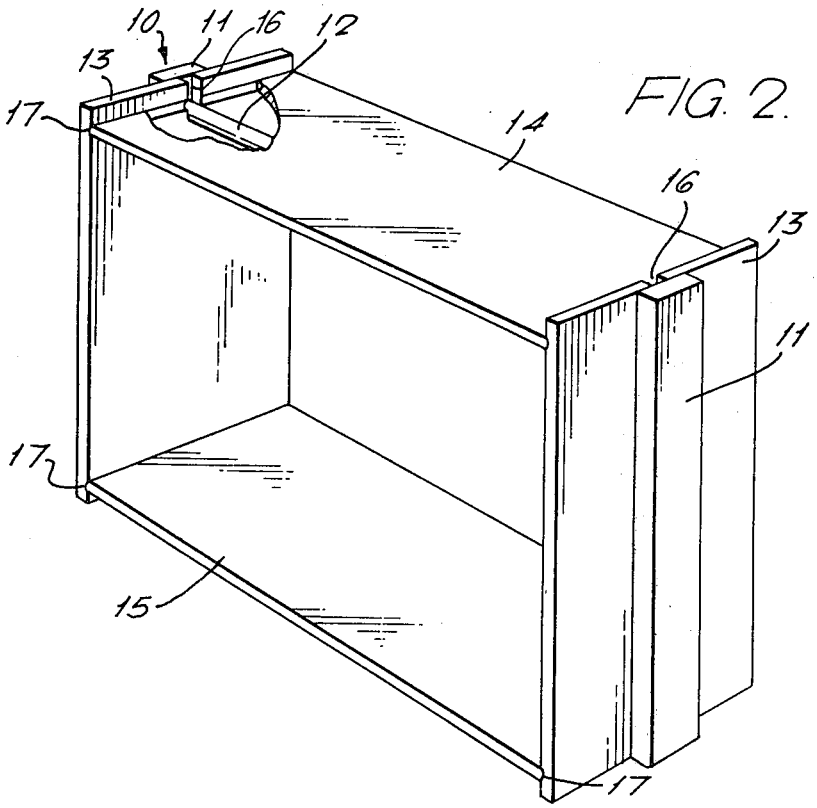
FIG. 2 shows the partly assembled book shelf of FIG. 1 in perspective view.

The shelf unit shown in FIGS. 1 and 2 consists of a rectangular frame 10 comprising a pair of rectangular posts 11 and a pair of horizontal rails 12 of circular cross-section. This frame is assembled in the factory as a completed unit.

In addition to the frame 10, the shelf unit basically comprises two pairs of particle board panels, namely a pair of vertical end panels 13, and top and bottom panels 14 and 15 respectively. Each of the vertical panels 13 is provided at its ends with a centrally located recess 16 the width of which corresponds to the diameter of the rails 12, and the distance between the bottom of each recess 16 corresponds to the spacing of the rails 12. In this way, the panels 13 may be assembled within the frame 10 by placing each panel respectively between the rails 12 in an oblique position and forcing the panel against the inner surface of the adjacent post 11 so that the recesses 16 amd the rails 12 are forced into engagement.

Each panel 13 is provided on its inner surface with a pair of grooves 17 for the reception of the rounded ends of the panels 14 and 15, these panels are slid into the assembly thereby locking the end panels 13 against the posts 11 and forming a rigid structure.

If desired, small pieces of resilient material such as rubber may be provided on the inner surfaces of the posts 11 opposite the grooves 17 of the vertical panels, to provide a degree of resiliency in the inter-engagement of these panels with the top and bottom panels 14 and 15.

The shelving unit is completed by the mounting of shelves, by means of conventional pins, between the vertical panels 13.

It would be seen that the unit illustrated is assembled without the use of any tools at all.

Using this basic principle of construction many different structures can be designed, and modifications of the unit illustrated will be obvious to those skilled in the art, whereby such items of furniture as cupboards, wardrobes, desks and the like may be constructed on the same principle.

In the construction of such units as cupboards and wardrobes, the present invention gives particularly good results. In conventional wardrobe construction, for example, the back of the wardrobe is essential to the rigiidity of the structure, and the doors being of course mounted at the front, are remote from the most rigid part of the structure. In the present invention the rigid frame is located centrally and thus closer to the doors, reducing the tendency of the unit to flex during opening and closing of the doors, and giving greater rigidity to the structure as a whole.

Figure 3:
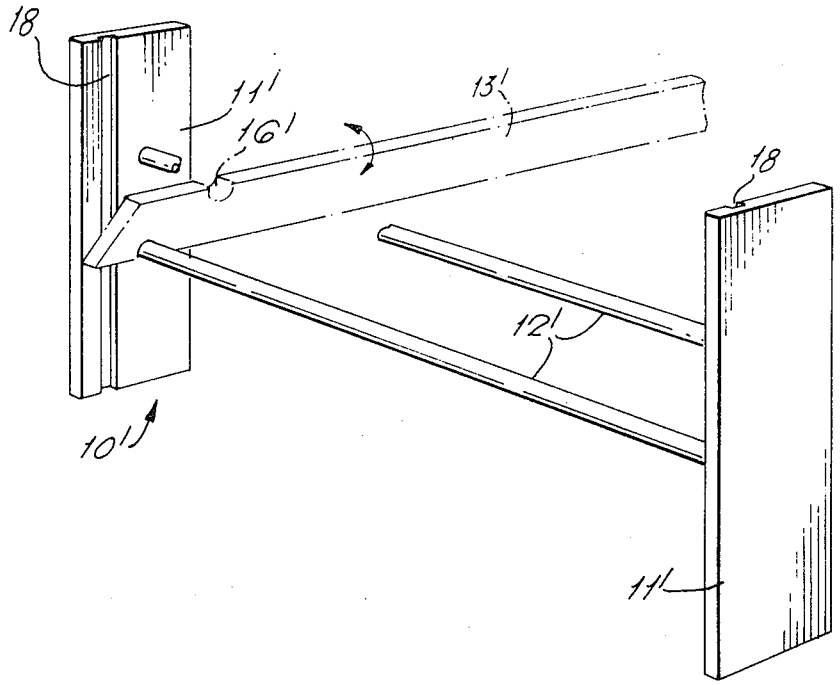
FIGS. 3 to 5 illustrate a somewhat different application of the present invention to the construction of a knock-down bed and FIG. 6 illustrates the application of the present invention to the construction of a table.
Figure 4:
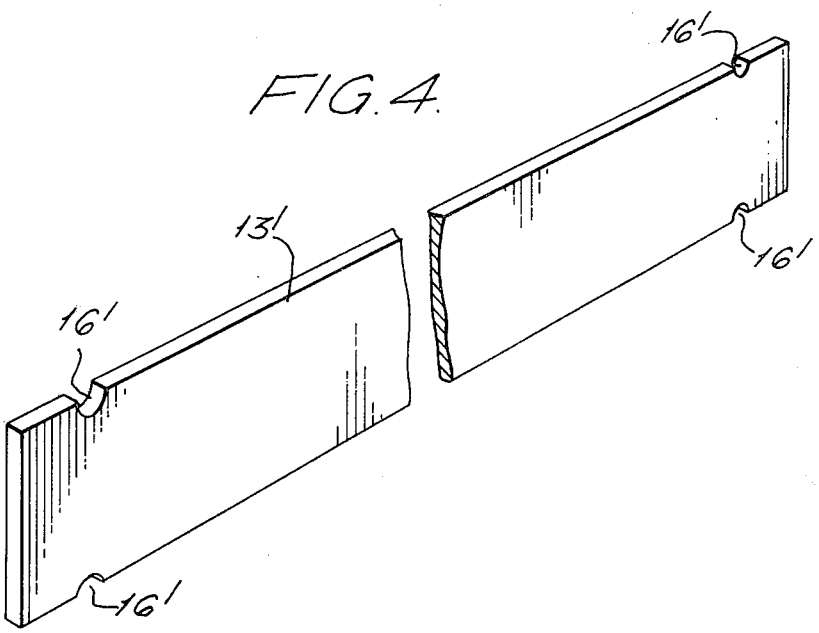
Figure 5:
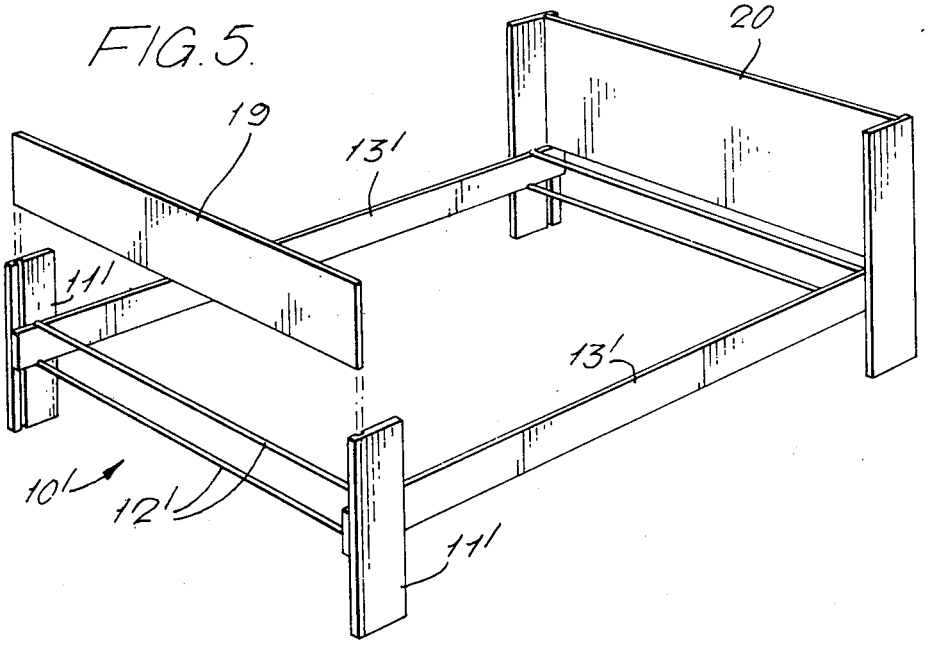

In an extension of the principle of the present invention, the panels exemplified by the vertical panels 13 of FIGS. 1 and 2 may be extended in their direction normal to the plane of the frame to constitute beams. Thus FIGS. 3, 4 and 5 show the basic structure adopted in the application of the present invention to the construction of a knock-down bed. In the drawings, only those parts of the assembly are illustrated which are essential to an understanding of its construction.

The bed consists essentially of a pair of particle board beams, only one of which is shown at 13', which extend along each side of the bed between a foot structure 10' (FIG. 3) and a head structure of similar design shown in FIG. 5.

The foot and head structures are assembled as rigid frames in the factory from a pair of wooden posts 11' joined by a pair of transverse rails 12'.

Provided in each of the inner surfaces of the posts 11' is a longitudinal groove 18 which extends above and below the rails 12' for the reception of foot and head boards 19 and 20 (FIG. 5), also of particle board.

The distance between the axes of the rails 12' is approximately equal to the height of the beam 13', and a pair of oppositely located recesses 16' is provided in each end of the beam for co-operation with the rails of the head and foot assemblies respectively. The shape of the grooves 16' conforms to the cross-sectional shape of the rails 12' (in the illustrated example circular) and the distance between the bottom of each recess of each pair is slightly greater than the distance between the adjacent surfaces of the rails 12', so that an interference fit is provided between the grooves and the rails.

The bed is assembled by placing each beam 13' between the rails as shown in FIG. 3 and twisting the beam to locate the grooves 16' in engagement with the rails 12'. In view of the interference fit between the rails and the recesses, the beam must first be placed in angular disposition between the rails and then forced into its final position against and parallel to the respective post 11'. The particle board of the beam 13' will be compressed in this operation and the beam will be securely maintained in engagement with the rails. The permanency of this construction is assured by the non-shrink properties of the particle board. The engagement between the inner surface of each post 11' and the opposed surface of the respective beam 13' together with the engagement between the recesses 16' and the rails 12' is found to be sufficient to provide the necessary horizontal rigidity of the structure.

Preferably , the surface of the recesses 16' is rounded by means of a spindle roller to avoid breaking or splitting of the groove ridges during assembly.

Clearly the principle of construction exemplified by this embodiment is capable of many modifications. For example only, the rails 12' may be eliminated and the necessary abutting surface for engagement with the recesses 16' may be provided by the opposed edges of a pair of end boards fixed within the grooves 18, these edges being spaced from each other by a distance corresponding to the spacing of the rails.

Figure 6:
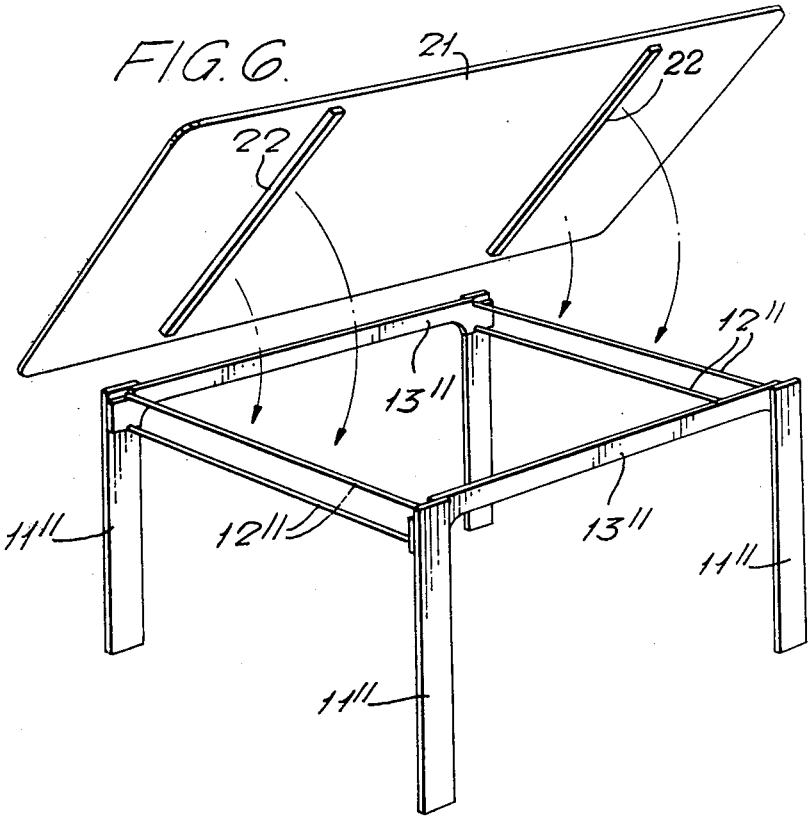

FIG. 6 shows a further embodiment of the present invention, in which a table is constructed from a pair of frames comprising legs 11'' and rails 12'', and side members 13'', assembled in the manner described above in relation to other embodiments. The table top 21 is located on the leg structure by means of a pair of ribs 22 which are spaced apart so as to fit nicely between the inner edges of the uppermost rails 12''.

In its application to other types of structure, the invention will of couse be modified with the compentence of those skilled in the art.

I claim:

1. A knock-down furniture component comprising first and second parallel panels positioned in facing relationship so as to have inwardly facing surfaces and outwardly facing rectangular frame means engageable with the outwardly facing surfaces of said first and second parallel panels for preventing outward movement of said panels away from each other and structural means positioned between and engaging other inwardly facing surfaces of said panels for preventing inward movement of said panels toward each other.

2. The invention of claim 1 wherein said first and second parallel panels are of elongated vertically extending configuration and include recesses in the ends thereof in which portions of said rectangular frame are received, wherein said first and second parallel panels extend beyond edge portions of said frame means.

3. The invention of claim 2 wherein said structual means comprises a top panel and a bottom panel having ends engaging top and bottom portions of said first and second parallel panels.

4. The invention of claim 1 wherein said rectangular frame means comprises first and second rectangular frames respectively engaging opposite ends of said first and second parallel panels.

5. The invention of claim 4 wherein said first and second parallel panels extend beyond edge portions of said frame means.

6. The invention of claim 5 wherein said first and second parallel panels comprise the sides of an item of furniture.

7. The invention of claim 4 wherein opposite sides of each of said rectangular frame members comprise an elongated table leg and said structural means includes a table top positioned on upper edge portions of said first and second parallel panels and downwardly extending ribs on the bottom of said table top mounted for engagement with the inwardly facing surfaces of said first and second parallel panels.

* * * * *